United States Patent [19]

Planke

[11] Patent Number: 4,579,267

[45] Date of Patent: Apr. 1, 1986

[54] CUTTING DEVICE FOR A CONTINUOUS PAPER WEB

[75] Inventor: Tore Planke, Nykirke, Norway

[73] Assignee: A/S Tomra Systems, Asker, Norway

[21] Appl. No.: 585,571

[22] Filed: Mar. 2, 1984

[30] Foreign Application Priority Data

Mar. 2, 1983 [NO] Norway ..... 830719

[51] Int. Cl.[4] ..... B26D 1/02

[52] U.S. Cl. ..... 225/54; 225/19; 225/43; 225/77; 225/91

[58] Field of Search ..... 225/19, 20, 43, 54, 225/72, 77, 89, 91

[56] References Cited

U.S. PATENT DOCUMENTS

| | | | |
|---|---|---|---|
| 2,121,346 | 6/1938 | Harvey | 225/54 X |
| 2,751,163 | 6/1956 | Waltz | 225/54 X |
| 2,817,404 | 12/1957 | Vogt | 225/91 X |
| 2,929,907 | 3/1960 | Collins | 225/54 X |
| 3,050,224 | 8/1962 | Hemgren | 225/38 |
| 3,217,953 | 11/1965 | Bahnsen | 225/54 X |
| 4,085,878 | 4/1978 | Nausedas | 225/19 |
| 4,267,949 | 5/1981 | Drolshammer | 225/106 |

FOREIGN PATENT DOCUMENTS

| | | |
|---|---|---|
| 2705175 | 8/1978 | Fed. Rep. of Germany . |
| 1306192 | 2/1973 | United Kingdom . |

*Primary Examiner*—Frank T. Yost

*Attorney, Agent, or Firm*—Kenyon & Kenyon

[57] ABSTRACT

A cutting device for a continuous paper web (4), said web being advanced from a paper web supply (8) by the aid of at least one advancing means (11, 14, 15) to a feed-out location (17) where the cutting may take place, a deflector (16) being provided downstream of said advancing means (11, 14, 15) and changing the direction of movement of said web (4), so that the web is advanced toward the feed-out location (17). A stationary knife (18) is provided downstream of said deflector (16), the edge of said knife (18) being arranged so as to face away from said feed-out location (17) and toward said deflector (16) and the edge of said knife forming an acute angle with said deflector means (16). Said deflector is a sheet shaped to be bendable toward the base of said knife, the edge of said knife (18) not contacting and cutting said paper web until the free end (4') of the web is pulled, e.g. by hand (19), in a direction forming an angle with said deflector (16) and, thus, bending it. The edge of the knife may have an optional shape.

7 Claims, 6 Drawing Figures

CUTTING DEVICE FOR A CONTINUOUS PAPER WEB

The present invention relates to a cutting device for a continuous paper web, said web being fed from a paper web supply over at least one advancing means to a feed-out location where cutting may take place, and where a deflector means is placed downstream of said advancing means and changes the direction of movement of the web so that the web is advanced towards said feed-out location.

There are previously known cutting devices, e.g. in the shape of inclined, serrated, sharp toothed, arcuate or straight tear off edges. Such means are among others known from ticket issuing machines, tape dispensers, and the like. All these devices have the great disadvantage that they require that the paper is advanced towards said tear off edge in one or another inclined direction for tearing off. This may function satisfactorily in a "closed" environment where the operators are trained. In connection with equipment used by the public (e.g. ticket issuing machines or other receipt issuing equipment) it has proved to be unpractical. The sole acceptable solution has, thus, been to use perforated paper webs or automatic scissors. Furthermore, the tear off edge, typically being very sharp, is often exposed in such a manner that serious cutting injuries to the fingers holding the web material may result.

Devices of the kind mentioned above are also known, which comprise a movable knife that is moved across the web to cut it. Such a knife could be controlled by electromagnetic means to be moved from a resting position into the position for cutting the paper web. However, the known device requires an arrangement of the paper web to achieve a guillotine effect for cutting. This makes the known solution even more complicated.

In connection with the known device it also occurs that the paper web is gripped and pulled before the cutting of the paper web has been completed. Thus, in the first place the paper consumption will increase considerably, and the electromechanically controlled knife may be damaged because it is subjected to a force perpendicular to the plane of the cutting edge at the moment of cutting. Problems of this kind are among others known from printing means arranged in connection with ticket issuing machines and bottle-return devices.

It is, thus, an object of the present invention to provide a cutting device which prevents the above mentioned problems.

According to the invention, it is suggested that a stationary knife is provided downstream of the deflector means, the edge of the knife being oriented in such a manner that it faces away from the feed-out location and toward said deflector means and the edge of the knife forming an acute angle with said deflector means, and that said deflector means is a sheet formed so as to be able to bend toward the base portion of the knife. Consequently the edge of the knife will not engage the paper web and cut it until the free end of the web is pulled, e.g. manually, in a direction forming an angle with the deflector means and, thus, bends said means.

According to another feature of the cutting device the edge of the knife may be arrow shaped having portions forming an obtuse angle. Alternatively, said edge may be shaped like a guillotine blade or have saw-tooth form. The device according to the invention can be used for example in a paper impressing/imprinting device, e.g. of the kind that is provided with means for acting on heat sensitive paper.

The present invention will now be described in more detail with reference to the attached drawing, where FIG. 1 shows the cutting device arranged in connection with a paper imprinting device, FIG. 2 illustrates the solution of FIG. 1 in perspective view, FIG. 3 is a perspective view of the cutting device per se, and FIG. 4 is a front view of the arrangement shown in FIG. 1.

Figure 1:
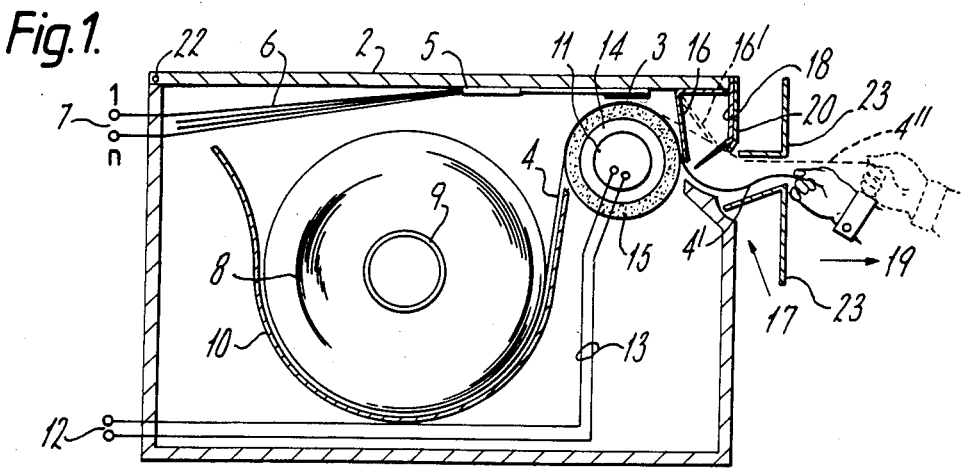

In FIG. 1 depicting one knife blade embodiment the present device is shown in connection with a paper imprinting device, comprising a housing 1 that may be closed by a cover 2. On the side facing down of cover 2 an imprinting member 3 for heat sensitive paper 4 is provided. Said imprinting member 3 is connected via a connector 5 and a number of wires 6 to a terminal connector 7 having n points of connection corresponding to the number of wires in the set of wires 6. The paper 4 is web shaped and is fed from a paper supply 8 in the form of a roll of paper wound on a core 9. Said paper roll 8 is loosely placed in a holder means 10 in the exemplified embodiment shown.

The web 4 is advanced past the imprinting member 3 by the aid of an advancing means 11, said imprinting member achieving a good contact with said paper web due to the weight of the cover 2 or due to a force being exerted on the cover 2. The advancing means may comprise a motor 11 of the kind having a circular-cylindrical motor housing which rotates when the motor receives current from a terminal 12 via wires 13. The motor housing 14 may be coated with a friction coating 15 in a manner known per se.

Figure 4:
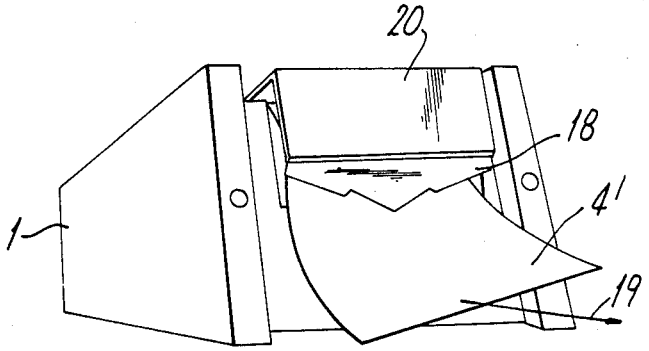

After having passed the imprinting member the paper web 4 is fed toward a deflector sheet 16 guiding the paper toward the feed-out location 17. As clearly shown in FIG. 1, an inclined knife 18 is provided downstream of said deflector means, that may have the shape of a sheet, the front portion of the edge of the knife 18 being approximately flush with the plane of said sheet 16. Thus, as long as only the advancing means 11 advances paper web 4 said web will not be influenced by the knife but just pass it. If, however, the free feed-out end 4' of the paper web 4 is pulled by hand in the direction of the arrow 19, i.e. in a direction forming an angle with sheet 16 so that said paper web once more experiences a marked change of direction, the paper web will contact the edge of the knife and, thus, be cut. This is further illustrated in FIG. 4. As, indeed, will appear from FIG. 1, the sheet 16 which is bendable, will bend toward a position 16' when paper web 4 is pulled and torn off against the knife 18. At the end, the paper web will have a position 4" just before it is completely cut. The shown hand, then, has a position as indicated by the dotted lines.

To achieve a maximum controlled tear-off action for the paper web, it is suggested according to the present invention to provide a special feed-out opening 23 at the feed-out location 17. This ensures that when web end 4' is pulled the web will always be cut and it will be impossible for the fingers to contact the knife 18.

As indicated in FIG. 1 the knife 18 may be supported by a plate 20.

Figure 2:
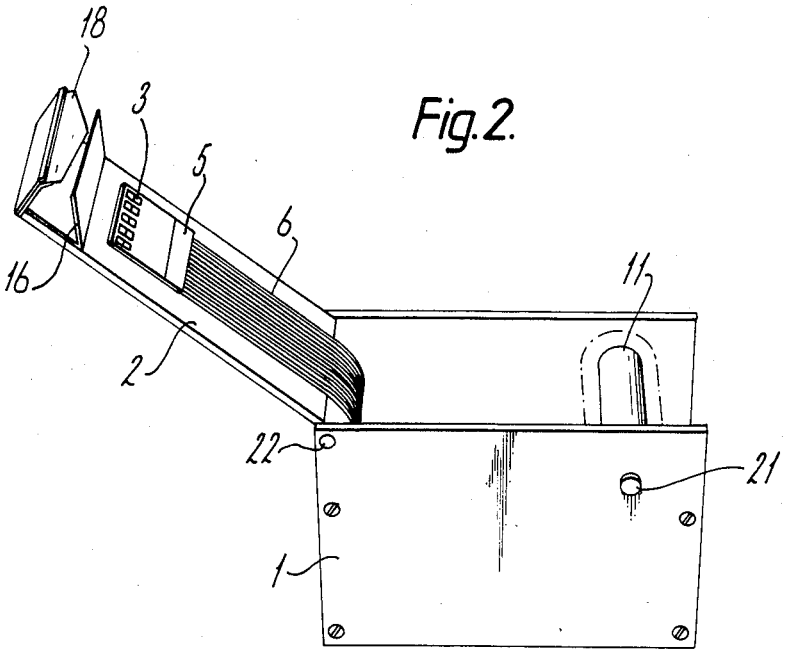

As indicated in FIG. 2, advancing means 11 may in a manner known per se be supported by bearing 21 in the side walls of housing 1. The cover 2 can in a manner known per se be rotatably connected with housing 1 by a hinged connection 22.

Figure 3:
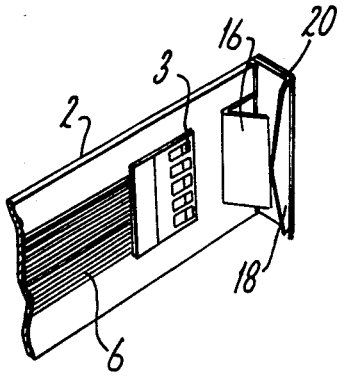
Figure 5:
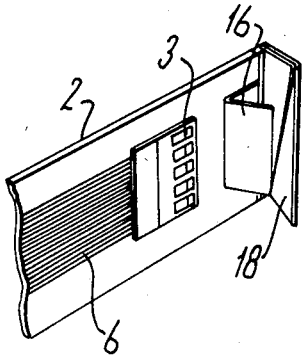
FIG. 5 is a view of the arrangement in FIG. 3, depicting another knife blade embodiment.
Figure 6:
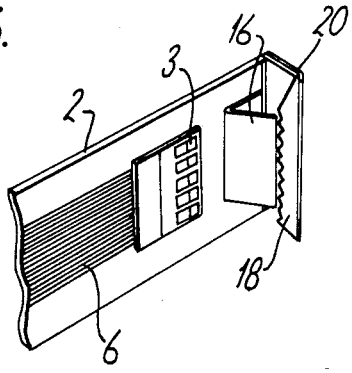
FIG. 6 is a view of the arrangement shown in FIG. 3, depicting still another knife blade embodiment.

As noted above, the knife blade of the present invention may be arrow shaped (18 in FIG. 3), guillotine shaped (18 in FIG. 5) or saw-tooth shaped (18 in FIG. 6).

I claim:

1. A cutting device for a continuous paper web comprising:

a housing adapted to receive and rotatably hold a supply of the paper web, the housing having an feed-out location such that the paper web as it is unwound from the supply may pass out of the housing:

means for advancing the web through the feed out location;

a knife positioned between the feed-out location and the advancing means, the knife having a sharp edge directed toward the advancing web and away from the feed-out location; and a flexible deflector located between the knife and the advancing means deflecting the web away from the knife as the web passes through the feed-out location, such that when an external force is applied to the web in the direction in which the web is already moving the deflector bends and the web comes in contact with and is cut by the knife.

2. A cutting device as stated in claim 1, wherein the edge of the knife is arrow shaped comprising portions that form an obtuse angle with one another.

3. A cutting device as stated in claim 1, wherein the edge of the knife is shaped as a guillotine blade.

4. A cutting device as stated in claim 1, wherein the edge of the knife is saw tooth shaped.

5. The cutting device in accordance with claim 1 wherein the web supply is a roll of paper wound on a core.

6. The cutting device in accordance with claim 1 wherein the advancing means comprises:

a rotatable circular-cylindrical motor housing, the housing having an outside surface in contact with the web such that when the housing is rotated, the web is advanced; and means for rotating the housing.

7. The cutting device in accordance with claim 6 wherein the housing surface is coated with a friction coating.

* * * * *